United States Patent [19]

Jaffe

[11] 4,061,876

[45] Dec. 6, 1977

[54] ELECTRONIC SOUND ENHANCING SYSTEM

[75] Inventor: J. Christopher Jaffe, Norwalk, Conn.

[73] Assignee: Jaffe Acoustics, Inc., Norwalk, Conn.

[21] Appl. No.: 617,215

[22] Filed: Sept. 26, 1975

[51] Int. Cl.[2] ..... H04R 3/00

[52] U.S. Cl. ..... 179/1 AT

[58] Field of Search ..... 179/1 AT, 1 J

[56] References Cited

U.S. PATENT DOCUMENTS

| | | | |
|---|---|---|---|
| 1,890,742 | 12/1932 | Messmer | 179/1 AT |
| 2,107,804 | 2/1938 | Roux et al. | 179/1 J |
| 2,931,862 | 4/1960 | Vermeulen et al. | 179/1 J |
| 3,392,240 | 7/1968 | Parkin | 179/1 AT |
| 3,614,320 | 10/1971 | Volkmann | 179/1 J |
| 3,796,832 | 6/1972 | Jaffe | 179/1 J |

FOREIGN PATENT DOCUMENTS

| | | | |
|---|---|---|---|
| 1,002,778 | 8/1965 | United Kingdom | 179/1 J |

*Primary Examiner*—George G. Stellar
*Attorney, Agent, or Firm*—Blum, Moscovitz, Friedman & Kaplan

[57] ABSTRACT

An electronic sound enhancing system for improving the symphonic criteria of sound emanating from a performing shell is provided. Microphones are disposed in the performing shell for receiving sound emanating therefrom and converting same to an audio signal. Reverberant field loudspeakers are positioned with respect to the performing shell to produce low frequency reverberant field sound. Forestage loudspeakers are disposed proximate the shell for emitting sound representative of the early first reflections of the sound emanating from the performing shell. Time delay circuitry disposed intermediate the microphones and the reverberant field loudspeakers and forestage loudspeakers respectively apply the audio signal to the reverberant field loudspeakers delayed by a first predetermined interval of time and to the forestage loudspeakers delayed by a second predetermined interval of time.

6 Claims, 3 Drawing Figures

ELECTRONIC SOUND ENHANCING SYSTEM

BACKGROUND OF THE INVENTION

This invention is directed to an electronic system for enhancing the sound emanating from a performing shell, and in particular to the use of a series of loudspeakers forward of the performing shell for electronically simulating and/or improving the symphonic criteria of good concert hall sound.

The use of enclosed auditoriums not particularly constructed to provide for good concert hall design, and even more so, open air performing shells, wherein the sound emanates from a stage formed in part of a shell consisting of at least a back wall and floor, causes sound to be produced, the articulation, intimacy, warmth and presence, of the sound referred to as symphonic criteria, being far below that obtainable in a concert hall. Due to the absence of ceilings and walls in an open enclosure, and the considerable expanse of many auditoriums not particularly designed for symphonic use, sound reflections, a critical aspect in providing for symphonic criteria are either entirely lost or sufficiently attenuated as to provide less than completely satisfactory musical acoustics. Heretofore, in closed auditoriums, the obtaining of good concert hall sound was only possible through expensive architectural manipulations including the raising and lowering of ceilings, the introduction of variable amounts of drapery materials and the use of suspended panels on walls and ceilings for reflecting sound, such architectural manipulations being extremely expensive and denigrating certain symphonic criteria in an attempt to improve the other such criteria.

SUMMARY OF THE INVENTION

Generally speaking, in accordance with the invention, an electronic sound enhancing system for use in improving the symphonic criteria of sound emanating from a performing shell is provided. Microphones for receiving sound emanating from a performing shell and converting same to an audio signal are provided. First reverberant field loudspeakers are positioned with respect to the performing shell to produce reverberant field sound in response to an audio signal being applied thereto and forestage loudspeakers are disposed proximate the shell for emitting sound representative of the early first reflections of the sound emanating from the shell in response to an audio signal being applied thereto. Time delay circuitry is disposed intermediate the microphones and the reverberant field loudspeakers and forestage loudspeakers for respectively applying the audio signal produced by the microphones to the reverberant field loudspeakers delayed by a first predetermined interval of time and to the forestage loudspeakers delayed by a second predetermined interval of time.

Accordingly, it is an object of the instant invention to provide an improved sound enhancing system for electronically enhancing the symphonic criteria of sound emanating from a performing shell.

A further object of the instant invention is to provide an improved electronic sound enhancing system including forestage loudspeakers for electronically reproducing first reflections of sound emanating from a performing shell.

Still a further object of the instant invention is to provide a sound enhancing system including reverberant field loudspeakers for reproducing low frequency reverberant field sound emanating from a performing shell.

Still a further object of the instant invention is to provide an improved electronic sound enhancing system for improving the symphonic criteria of sound in an auditorium without effecting architectural manipulation of same.

Still other objects and advantages of the invention will in part be obvious and will in part be apparent from the specification.

The invention accordingly comprises the features of construction, combination of elements and arrangements of parts which will be exemplified in construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
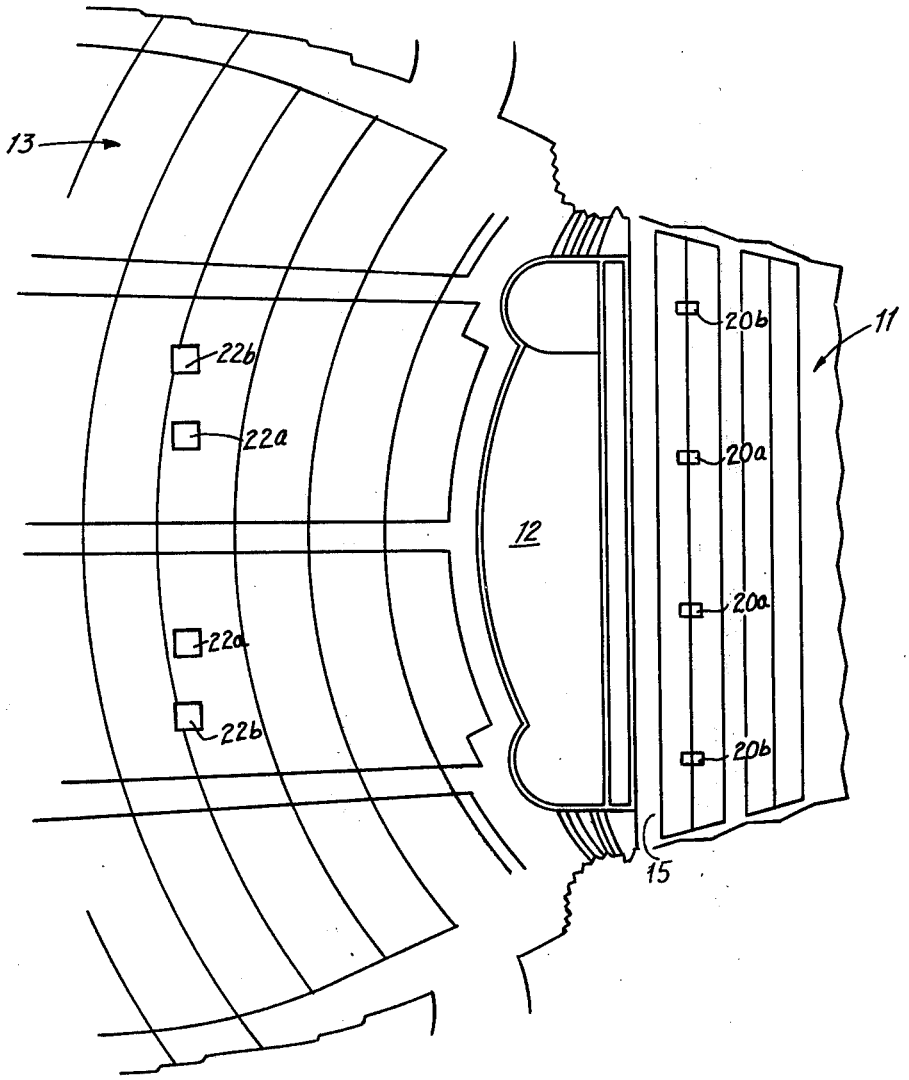
FIG. 1 is a partial diagramatic plan view of an auditorium including an electronic sound enhancing system constructed in accordance with the instant invention.
Figure 2:
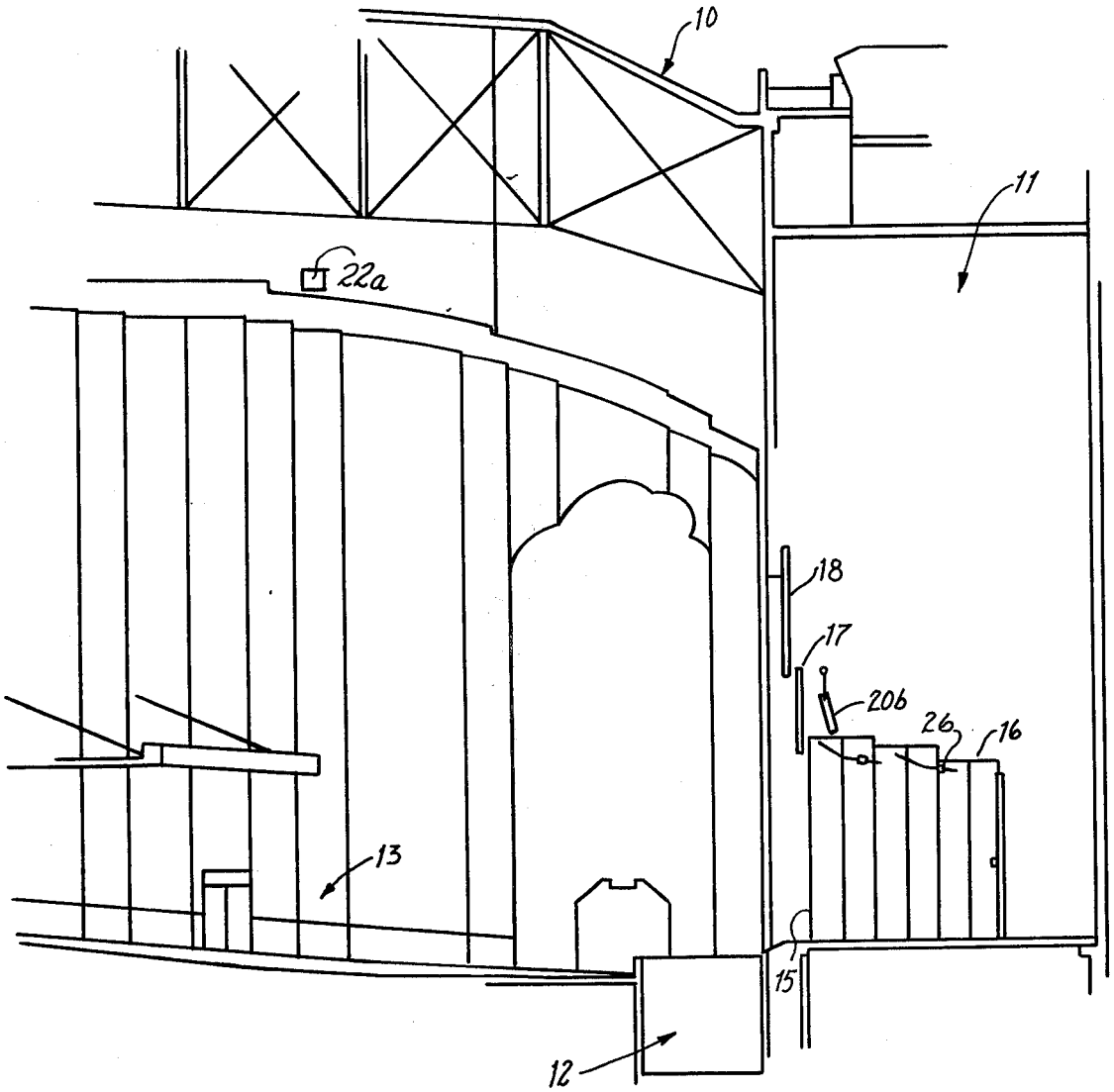
FIG. 2 is a partial sectional diagramatic elevational view of the auditorium depicted in FIG. 1.

Reference is now made to FIGS. 1 and 2 wherein an auditorium generally indicated at 10 includes a performing area, generally indicated as 11, an orchestra pit generally indicated as 12, and an audience area generally indicated as 13. The performing area 11 includes a stage 15, concert enclosure 16, and scrim 17 and is adapted to be selectively enclosed by a curtain 18. For purposes of simplifying the instant application, the performing area defined by at least the stage 15 and concert enclosure 16 is hereinafter referred to as the "performing shell", it being noted that the instant invention as defined herein is equally applicable to an entirely enclosed concert hall as to an open air concert hall having a performing shell including such a concert enclosure and stage.

Suspended over the stage at the proscenium arch proximate the scrim 17 are the electronic forestage canopy loudspeakers **20*a* and 20*b*, which loudspeakers are adapted to produce sounds representative of the early first reflections of the sound emanating from the performing shell. Disposed in the upper reverberant area of the auditorium are a plurality of reverberant field loudspeakers 22*a* and 22*b* adapted to produce low frequency reverberant field signals for providing the sensation of acoustical warmth to the audience area 13. The signals applied to the respective electronic forestage loudspeakers 20*a* and 20*b* and the reverberant field loudspeakers 22*a* and 22*b* are produced by wall mounted microphones 26 disposed on the rear, side and ceiling walls of the concert enclosure 16**.

It is noted that a preferred embodiment of the instant invention incorporates the use of miniature microphones implanted on the surface of the walls defining the concert enclosure at selected positions, the implanting of the microphones on the walls substantially doubling the energy of the input thereof that would be received were the microphones disposed in air at a distance closer to the source from which the sound is emanating. It is further noted that the electronic forestage canopy loudspeaker should be disposed proximate the scrim in order to provide no more than 5 to 10 milliseconds of natural delay from the forestage canopy loudspeakers to the audience area.

Figure 3:
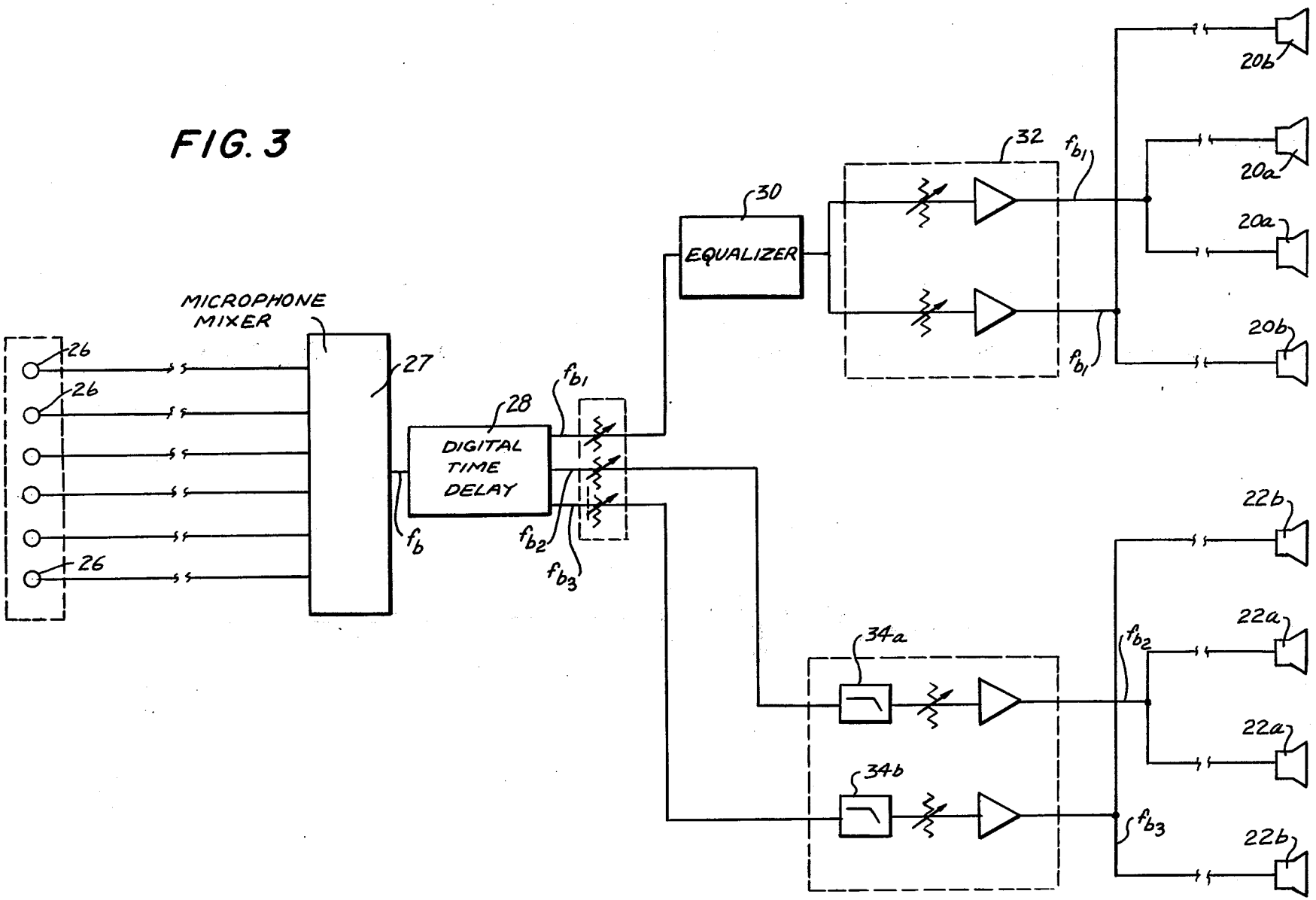
FIG. 3 is a block circuit diagram of the electronic sound enhancing system constructed in accordance with the instant invention.

Referring now to FIG. 3, a detailed circuit diagram of the electronic sound enhancing system for energizing the reverberant field loudspeakers 22*a* and 22*b* and the forestage canopy loudspeakers 20*a* and 20*b* disposed in the performing shell is depicted. Microphones 26 are coupled to a microphone mixer 27, which mixer is adapted to receive the respective audio signals produced by each microphone and in response to each of the audio signals applied thereto produce a common output signal $f_b$. The common output signal $f_b$ is thereafter applied to a digital time delay circuit 28, which circuit produces signals $f_{b1}$, $f_{b2}$ and $f_{b3}$, or any sufficient series of signals required for a particular application, each signal being delayed a predetermined time interval determined by the positioning of the respective reverberant field loudspeakers and forestage canopy loudspeakers to which the signals are to be applied. The digital time delay circuit is adjusted to provide respective output signals $f_{b1}$, $f_{b2}$ and $f_{b3}$, selectively delayed, by way of example, over a range of 0–120 milliseconds at 10 second intervals. Each of the respective delayed output signals $f_{b1}$, $f_{b2}$ and $f_{b3}$ are applied to a balance control panel comprised of a conventional attenuation circuit in order to effect transmission of the respective time delayed output signals at appropriate levels in relation to sound pressure levels of the natural source of sound emanating from the performing shell. First delayed output signal $f_{b1}$ is applied by the balance control panel to an equalizer circuit 30, which equalizer circuit effects an adjustment of the signal $f_{b1}$ to simulate the frequency spectrum reflected from panels of different mass and size. Thereafter, the first delayed output signal $f_{b1}$ is applied to the electronic forestage canopy amplifier circuit 32 which effects a splitting of the signal to provide for selective adjustment of the amplitude of the split signals as same are respectively applied to the forestage canopy loudspeakers 20*a* and 20*b*. The respective amplitudes of the split signals applied to the forestage loudspeakers are dependent on the configuration of the listening area. The remaining two time delayed audio signals $f_{b2}$ and $f_{b3}$ after being applied to the balance control panel to adjust the respective attenuations therein are respectively applied to a low pass filter and amplification circuit including low frequency band pass filters 34*a* and 34*b*, designed to pass frequencies over a range of 30 Hz to 250 Hz, whereafter low frequency audio signals passed thereby respectively applied to the reverberant field speakers 22*a* and 22*b*.

In operation, the electronic forestage canopy loudspeakers 20*a* and 20*b* receive output signal $f_{b1}$ with a sufficient time delay and frequency band to provide sound representative of the early first reflections, which first reflections provide a sensation of acoustical intimacy, presence and articulation. Similarly, the reverberant field loudspeakers disposed in the upper reverberant area of the auditorium recieve properly timed low frequency audio signals $f_{b2}$ and $f_{b3}$ and reproduce same to provide a sensation of acoustical warmth. Acting together the forestage canopy loudspeakers and reverberant field loudspeakers provide an acoustical envelope capable of satisfying the basic criteria of good concert hall design without the necessity of implementing expensive architectural manipulations. Even in open air arenas wherein only the performing shell is utilized, the reverberant field loudspeakers are able to provide a concert hall effect.

It is noted that the optimum number and locations at which the respective reverberant field loudspeakers and forestage canopy loudspeakers are disposed, are easily determined by one skilled in the art. Similarly, the time delays between the respective audio signals applied to the forestage canopy loudspeakers and reverberant field loudspeakers, the number of loudspeakers and the series of signals required for a particular application are particularly tuned to the respective concert hall and accordingly will be readily determined by the person of ordinary skill.

In an actual embodiment of the electronic sound enhancing system illustrated in FIG. 3, the following components, detailed by type and manufacture are utilizable therein:

| | | |
|---|---|---|
| FORESTAGE CANOPY LOUDSPEAKERS | CM-209-6 | Bozak |
| FORESTAGE CANOPY AMPLIFIER | CMA-2-150 | Bozak |
| FORESTAGE CANOPY EQUALIZER | 527-A | United Recording Electronics Industries |
| REVERBERANT FIELD LOUDSPEAKERS | CM-199-2 | Bozak |
| REVERBERANT FIELD AMPLIFIER | CMA-2-150 | Bozak |
| REVERBERANT FIELD AMPLIFIER FILTERS | CMA-18 | Bozak |
| DIGITAL TIME DELAY UNIT | DA-4003 | Industrial Research |

Accordingly, the instant invention provides for the enhancement of the syphonic criteria of the sound emanating from the performing shell to obtain articulation, intimacy, warmth and presence heretofore only obtainable in concert halls, in auditoriums and open air performing shells. Moreover, the instant invention is particularly suitable for enhancing the electronic sound of concert halls without effecting architectural manipulations thereof.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. An electronic sound enhancing system for use in improving the symphonic criteria of sound emanating from a performing shell comprising in combination microphone means for receiving sound emanating from said performing shell and converting same to an audio signal, time delay means coupled to said microphone means for receiving said audio signal and respectively producing an audio signal delayed by a first time interval and an audio signal delayed by a second time interval, low pass filter means coupled to said time delay means for receiving said audio signal delayed by a first time interval and producing a narrow range audio signal, reverberant field loudspeaker means positioned with respect to said performing shell for receiving said narrow range audio signals delayed by a first time interval to thereby produce narrow range reverberant field sound, and forestage canopy loudspeaker means disposed proximate to said performing shell for simulating a forestage canopy panel by emitting sounds representative of early first reflections of said sound emanating from said performing shell in response to said audio signal delayed by a second time interval being applied thereto.

2. An electronic sound enhancing system as claimed in claim 1, including equalizer means disposed intermediate said time delay means and said forestage canopy loudspeaker means for equalizing said audio signal delayed by said second predetermined interval and applying said equalized signal to said forestage canopy loudspeaker means to simulate the frequency spectrum of reflection of a panel of predetermined mass and size.

3. An electronic sound enhancing system as claimed in claim 1, wherein said reverberant field loudspeaker means includes at least two loudspeakers adapted to produce sound in response to said low frequency range audio signal delayed by a first predetermined interval of time being applied thereto.

4. An electronic sound enhancing system as claimed in claim 3, wherein said reverberant field loudspeaker means includes at least one further loudspeaker adapted to receive an audio signal delayed by a third interval of time, said time delay means being further adapted to produce an audio signal delayed by a third interval of time, and further low pass filter means coupled intermediate said time delay means and said further loudspeaker for applying an audio signal having a low frequency range delayed by a third interval of time to said further loudspeaker means in response to said audio signal delayed by a third interval of time being applied thereto.

5. An electronic sound enhancing system as claimed in claim 1, wherein said performing shell includes at least one wall defining a concert enclosure, said microphone means including a plurality of microphones implanted in said wall defining the performing shell at selected positions therein.

6. An electronic sound enhancing system as claimed in claim 5, and including mixer means for receiving audio signals produced by each of said plurality of microphones implanted in the walls defining said performing shell, and in response thereto, applying said audio signal to said time delay means.

* * * * *